US005915685A

United States Patent [19]

Bausch et al.

[11] Patent Number: 5,915,685

[45] Date of Patent: Jun. 29, 1999

[54] SYSTEM FOR AUTOMATIC LOADING OF MAIL SORTING SYSTEM

[75] Inventors: Guenther Bausch, Immendingen; Josef Mok, Constance, both of Germany

[73] Assignee: Siemens Aktiengesellschaft, Munich, Germany

[21] Appl. No.: 09/091,016

[22] PCT Filed: Nov. 19, 1996

[86] PCT No.: PCT/EP96/05090

§ 371 Date: Jun. 8, 1998

§ 102(e) Date: Jun. 8, 1998

[87] PCT Pub. No.: WO97/20644

PCT Pub. Date: Jun. 12, 1997

[30] Foreign Application Priority Data

Dec. 7, 1995 [DE] Germany ..... 195 45 716

[51] Int. Cl.[6] ..... B65H 1/08; B65H 1/26

[52] U.S. Cl. ..... 271/157; 271/146; 271/152

[58] Field of Search ..... 271/149, 152, 271/154, 157, 162; 414/798.6, 798.7, 795.8

[56] References Cited

U.S. PATENT DOCUMENTS

| | | | |
|---|---|---|---|
| 4,052,052 | 10/1977 | Müller | 271/157 |
| 5,044,877 | 9/1991 | Constant et al. | 271/149 X |
| 5,150,891 | 9/1992 | Svyatsky et al. | 271/157 X |
| 5,292,114 | 3/1994 | McConnell | 271/157 X |
| 5,398,931 | 3/1995 | Tohgoh | 271/157 X |

FOREIGN PATENT DOCUMENTS

| | | |
|---|---|---|
| 393820 | 12/1991 | Austria . |
| 0423664 | 4/1991 | European Pat. Off. . |
| 0464771 | 1/1992 | European Pat. Off. . |
| 0591749 | 4/1994 | European Pat. Off. . |
| 41 17 434 | 12/1992 | Germany . |

*Primary Examiner*—Janice L. Krizek
*Attorney, Agent, or Firm*—Venable; George H. Spencer

[57] ABSTRACT

In addition to a separating blade which can pivot in and out and move in the direction of transport at a speed set by the stack pressure of the mail separation device (1) and back again, the proposed system also has a system with two separating blades which can also move in a straight line in the direction of transport and back again and can pivot into and out of the letter conveyor line. In addition, a charging module for automatically loading the system with letters is also provided. Once the letters have been loaded into the two-blade system, the latter moves towards the single separating blade. The single blade then swings out, travels behind the two separating blades which likewise move at a speed set by the stack pressure of the mail separation device (1) and swings back in. The separating blades of the separating blade system then swing out, move into their final position to receive new letters and the single separating blade conveys the letters to the mail separation device.

8 Claims, 2 Drawing Sheets

SYSTEM FOR AUTOMATIC LOADING OF MAIL SORTING SYSTEM

DESCRIPTION

Figure 1:
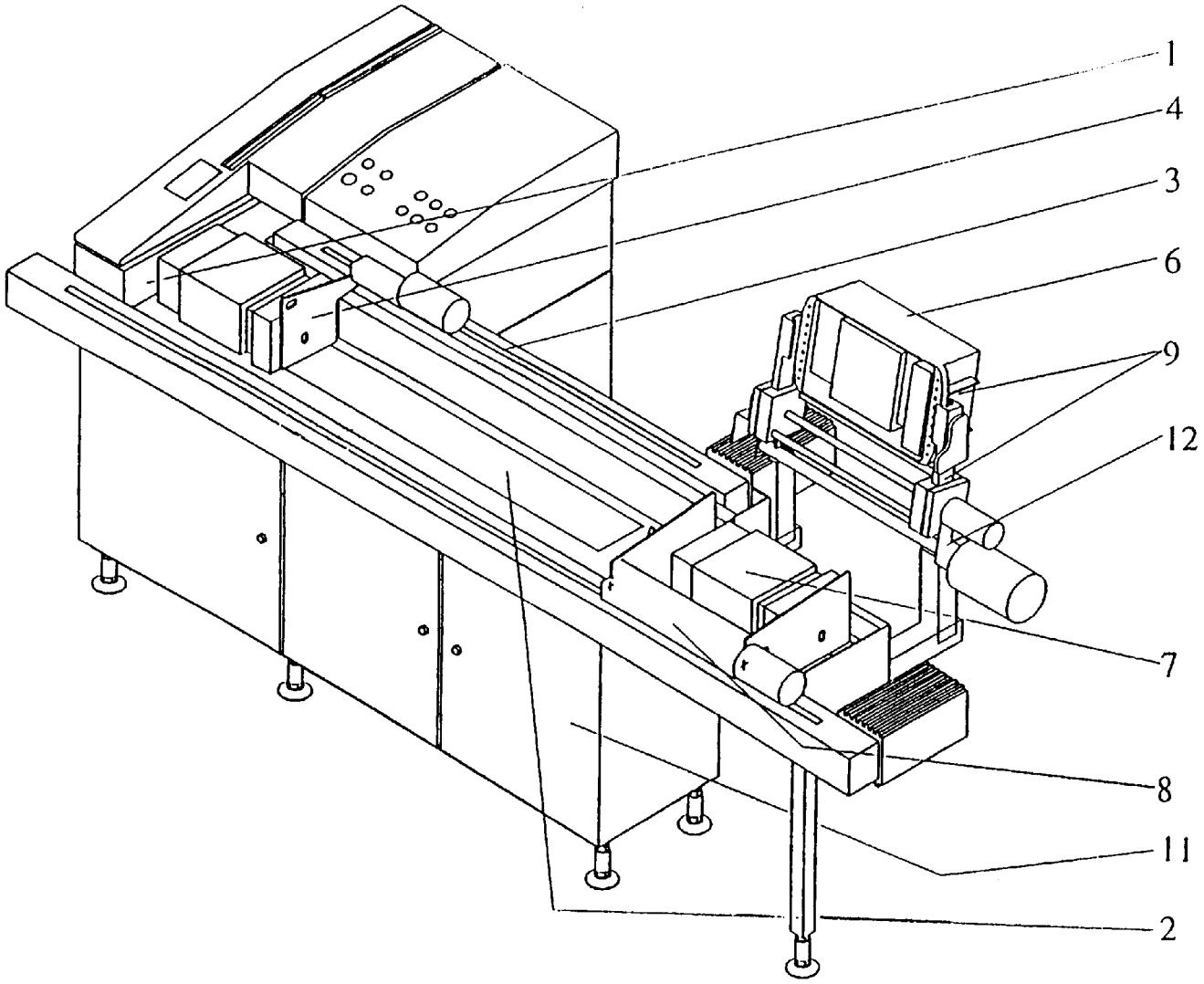

The invention concerns an arrangement for the automatic loading of material into a mail sorting system, in accordance with the preamble to patent claim 1.

So far, the input of material into mail sorting systems required an involved manual loading. For this, the items are emptied from the postal container onto the feed section or are placed manually in stacks onto the feed section. They are subsequently aligned, also manually, with respect to the letter front edge and lower edge and are pushed toward the pull-off device or the residual mail stack. The separating blade is pivoted in behind the stack and the item pull-off begins. In this case, the conveying belt in connection with the separating blade delivers the stack of letters to the pull-off and separating device, which separates the letters with a uniform spacing.

An arrangement with several separating blades for subdividing into several stacks is described in the EP 0 591 749 A1, wherein each stack contains items of a certain size category, e.g. thickness. The separating means can be adjusted to any size category. An automatic loading is not possible in this case.

The DE 41 17 434 A1 also discloses a solution with several separating blades. However, this relates to the forming of stacks, in particular stacks of envelopes, and their transport to a packaging station, wherein four separating blades are used.

It is the object of the invention, specified in claim 1, to automate the operation of loading material into a mail sorting system, so that manual activities are no longer required.

The dependent claims contain advantageous embodiments and modifications of the invention.

The loading module preferably comprises a receiving mechanism, mounted on a pivoting device, for accepting the mail container. The filled mail containers in this case are emptied with a pivoting movement onto the mail receiving section between the separating blades for the separating blade arrangement.

The mail receiving section preferably comprises a vibrator for aligning the letters.

Owing to the fact that a uniform filling degree for the postal containers cannot always be ensured, the spacing between the 2 separating blades of the separating blade arrangement can be adjusted according to one advantageous feature. Once the mail is emptied from the container, the two separating blades move toward each other until the stack of mail exerts a certain pressure on the separating blades.

It is preferable that a conveyor belt is used to deliver the mail containers to the loading module and also remove them again from the loading module. In order to support the mail transport, the mail conveying track for one preferred embodiment has a conveyor belt between the mail receiving section and the separating device, which moves synchronously with the pivoted-in single separating blade, as well as with the pivoted-in separating blades for the separating blade arrangement, if these guide the stack of mail toward the separating device.

A further feature of the invention provides that the mail conveying track is designed to be stationary, but is made of a material with low friction coefficient.

The invention is explained in more detail in the following with the aid of an exemplary embodiment and by referring to the drawings.

Figure 2:
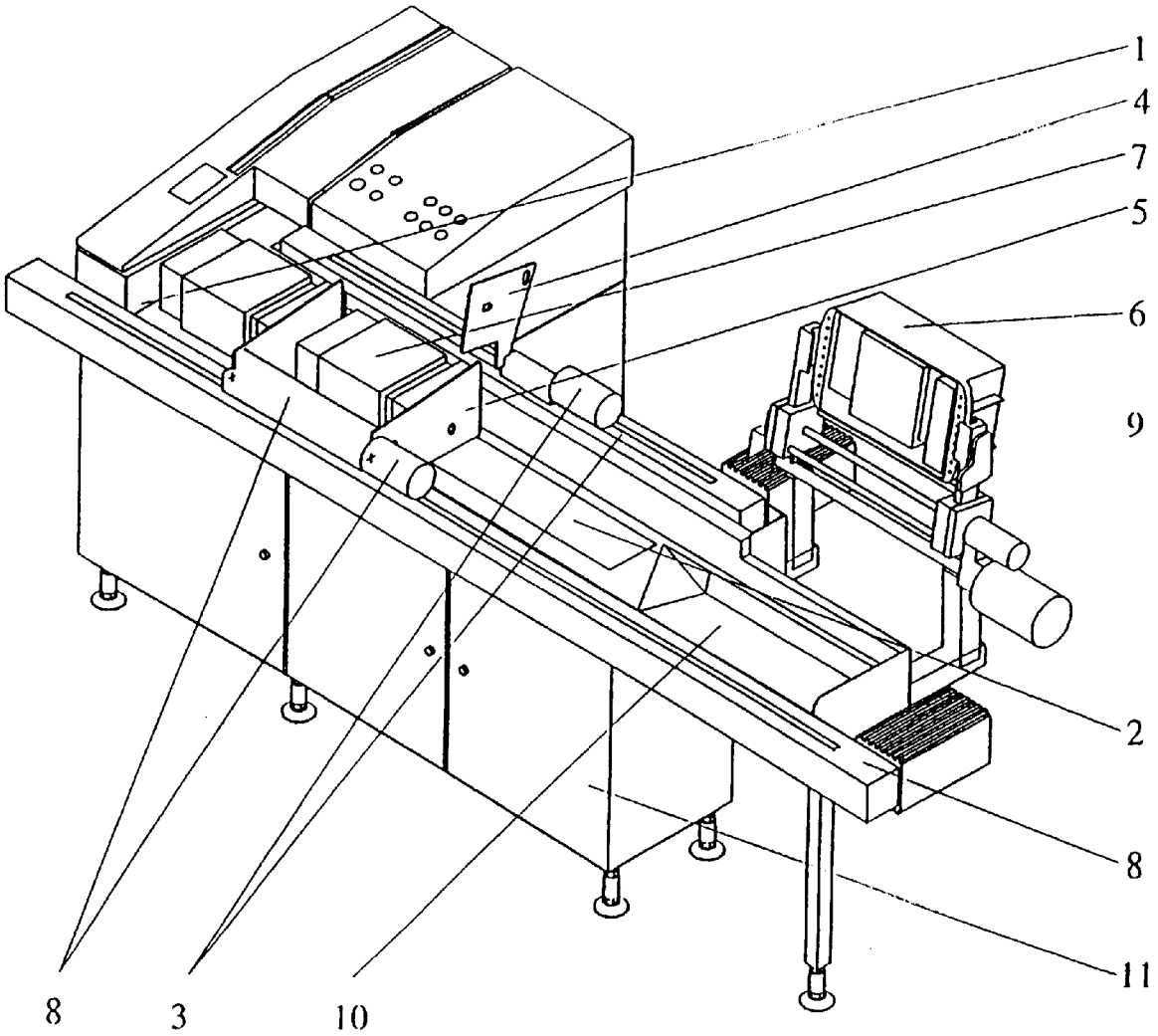

The following is shown here:

FIG. 1 A perspective drawing of the system with the stack of letters on the mail receiving section;

FIG. 2 A perspective drawing of the system shortly before the stack of letters is taken over by the single separating blade.

The postal container 6 filled with mail is transported to the loading module via a conveying belt 2, which is not shown in detail here and serves as a feed section. A receiving mechanism 9, designed as a parallel gripper, centers the postal container 6 in position. The postal container 6 is then pivoted with the aid of a pivoting device 12 by 180 degrees. The mass moment of inertia of the letter stack 7 is utilized to prevent the mail items from falling out of the postal container 6 during the pivoting operation, which is carried out at relatively high speed. Once the container is empty, the pivoting device 12 pivots back by 180 degrees and places the empty postal container 6 back onto the feed section. The conveying belt of the feed section then advances another step in the transport, until a full mail container is in position to be gripped.

The stack of letters 7 inside the postal container 6 drops onto a letter receiving section 10 between the separating blades of the separating blade arrangement 5 (FIG. 1). As a result of the rapid pivoting, the letters in the stack of letters 7 are in part aligned with their lower edges. A further alignment of the edges occurs through a jolting/vibrating movement in the letter receiving section 10 between the two separating blades. The linear unit of the traversing and pivoting device 8 for the separating blade arrangement 5 pushes the aligned stack of letters, located between the two separating blades, until just before the single separating blade 4, which moves at a speed V1 toward the separating device 1. A sensor located on the single separating blade 4 indicates via a signal from control 11 that the separating blade arrangement 5 is located just behind the single separating blade 4.

The speed V1 is preset by the control 11. The necessary advancing speed is adjusted by the control 11 via a pressure sensor on the separating device 1, in accordance with the selected stack pressure.

The single separating blade is then pivoted by 100 degrees and out of the transported stack of letters and moves into position behind the separating blade arrangement 5, which continues to advance at the speed V1 (see FIG. 2). The sensor at the single separating blade 4 signals the exact holding position behind the two separating blades of the separating blade arrangement 5. When pivoted in, the single separating blade 4 moves very close to the separating blade arrangement 5. The two separating blades of the separating blade arrangement 5 are then pivoted out and return to the starting position, while the single separating blade 4 continues to advance with the speed V1.

The receiving mechanism realized with a gripper is suitable for postal containers 6 of different size.

The distance between the two separating blades of the separating blade arrangement 5 can be adjusted for different sizes of postal containers 6 and can be controlled additionally via a pressure measurement, so that for partially filled postal containers 6, the distance between separating blades is adjusted to correspond to the actual letter stack width. In the most simple case, the pressure can be measured with an adjustable spring force and a contact, triggered for a specific spring path.

We claim:

1. A system for the automatic loading of material into a mail sorting system, comprising a separating device, a letter conveying track, a separating blade for pivoting in and out of the letter conveying track by means of a traversing and pivoting device (3) that can be moved forward and back again with speed V1, which is controlled via the stack pressure at the separating device and is designed to convey letters in a conveying direction to the separating device, as well as comprising a letter receiving section, characterized in that a separating blade arrangement (5) is provided, which can also be moved in a transporting direction and pivoted in and out of the letter conveying track by a traversing and pivoting device (8), said arrangement comprising two separating blades, the distance between them being such that during the takeover of the stack of letters (7) it corresponds at least to the inside length of a postal container (6) for the delivered stack of letters (7), wherein the traversing and pivoting devices (3, 8) are arranged on the side of the mail conveying track, in such a way that they do not interfere during their traversing and pivoting operations, and wherein the separating blade arrangement (5) with two separating blades can be moved relative to the single separating blade (4) by at least the length of the largest postal container (6), and in that a loading module is positioned on the side of the conveying track, adjacent the end position of the separating blade arrangement (5) and the letter receiving section (10) and on the side of the traversing and pivoting device (3) for the single separating blade (4), which loading module conveys the letters from the delivered, filled postal containers (6) automatically to the letter receiving section (10), and that a control unit (11) and sensors are provided, which ensure the following sequence of steps:

acceptance of the letter stack (7) into the letter receiving section (10) between the separating blades of the separating blade arrangement (5) while the separating blades are pivoted in;

moving of the letter stack (7), located in the separating blade arrangement (5), until just before the single separating blade (4) that moves with speed V1 in the direction of the separating device (1), pivoting out of the single separating blade (4) and moving back behind the separating blade arrangement (5), as well as advancing of the separating blade arrangement (5) with the speed V1, controlled via the stack pressure at the separating device (1), pivoting in of the single separating blade (4) and movement of this blade toward the separating blade arrangement (5) until it is just behind it, pivoting out of the two separating blades of the separating blade arrangement (5) and advancing of the single separating blade (4) with speed V1, controlled via the stack pressure at the separating device (1), moving back of the separating blade arrangement (5) to a position adjacent the letter receiving section (10).

2. A system according to claim 1, characterized in that the loading module has a receiving mechanism (9), attached to a pivoting device (12), for receiving the postal container (6), which receiving mechanism empties the filled postal containers (6) with a pivoting movement onto the letter receiving section (10) between the separating blades of the separating blade arrangement (5).

3. An arrangement according to claim 1, characterized in that the letter receiving section (10) has a vibrating device for aligning the edges of the letters.

4. An arrangement according to claim 1, characterized in that the distance between the two separating blades of the separating blade arrangement (5) can be changed, wherein following the takeover of a letter stack (7), the separating blades move toward each other until a certain pressure is exerted onto the separating blades.

5. An arrangement according to claim 1, characterized in that the filled postal containers (6) are conveyed to the loading module on a conveying belt, designed as a feed section, and once emptied are transported away from the loading module, wherein the feeding cycle is coordinated with the operating cycle of the loading module.

6. An arrangement according to claim 1, characterized in that the letter conveying track between letter receiving section (10) and separating device (1) consists of a conveyor belt (2), which moves synchronously with the pivoted-in single separating blade (4) as well as with the pivoted-in separating blades of the separating blade arrangement (5) when these blades guide the letter stack (7) toward the separating device (1).

7. An arrangement according to claim 1, characterized in that the letter conveying track is made of a material with a low friction coefficient.

8. An arrangement according to claim 2, characterized in that the filled postal containers (6) are conveyed to the loading module on a conveying belt, designed as a feed section, and once emptied are transported away from the loading module, wherein the feeding cycle is coordinated with the operating cycle of the loading module.

* * * * *